US006119891A

United States Patent [19]

Favre

[11] Patent Number: 6,119,891

[45] Date of Patent: Sep. 19, 2000

[54] HOUSING FOR A COSMETIC PRODUCT, POWDER BOX AND METHOD FOR OPENING THE HOUSING

[75] Inventor: Bernard Favre, Chevilly-Larue, France

[73] Assignee: Lir France, Chevilly-Larue, France

[21] Appl. No.: 09/084,347

[22] Filed: May 27, 1998

[30] Foreign Application Priority Data

May 27, 1997 [FR] France ..... 97 06485

[51] Int. Cl.[7] ..... B65D 43/14

[52] U.S. Cl. ..... 220/811; 220/833; 215/223; 215/237

[58] Field of Search ..... 220/811, 833, 220/836; 215/223, 237

[56] References Cited

U.S. PATENT DOCUMENTS

| | | | |
|---|---|---|---|
| 1,694,185 | 12/1928 | Leberman . | |
| 2,466,295 | 4/1949 | Algier . | |
| 2,555,473 | 6/1951 | Deaton | 220/833 X |
| 3,765,578 | 10/1973 | Stull | 215/223 X |
| 3,848,780 | 11/1974 | Stull | 215/223 X |
| 5,261,552 | 11/1993 | L'Hotel et al. | 220/337 |
| 5,297,687 | 3/1994 | Freed | 215/206 |
| 5,520,296 | 5/1996 | Freed | 215/206 |
| 5,542,561 | 8/1996 | Slink et al. . | |
| 5,702,013 | 12/1997 | Freed | 215/206 |

FOREIGN PATENT DOCUMENTS

| | | |
|---|---|---|
| 0 614 629 | 9/1994 | European Pat. Off. . |
| 08154730 | 6/1996 | Japan . |
| 08242937 | 9/1996 | Japan . |
| 09028451 | 2/1997 | Japan . |

*Primary Examiner*—Stephen K. Cronin
*Attorney, Agent, or Firm*—Nawrocki, Rooney & Sivertson, P.A.

[57] ABSTRACT

A housing having a bottom (3) provided with a wall (6) cylindrical with respect to an axis (7);

a cover (4) provided with a cylindrical wall (14);

a hinge (20) about an axis (21);

complementary portions (25, 26) for locking the bottom (3) and the cover (4), in which it has male (31) and female (32) parts extending in the direction of the axis (21); connected to the bottom (3), to the cover (4); the female part (32) having an end opening (33) allowing for the engagement of the male part (31); the female part (32) having the general shape of an arc of a circle centred on the main axis, the male and female parts (31, 32) occupying an engaged or disengaged position; the passage from one to the other being achieved through the pivoting of the cover (4) about the axis (7).

30 Claims, 6 Drawing Sheets

HOUSING FOR A COSMETIC PRODUCT, POWDER BOX AND METHOD FOR OPENING THE HOUSING

The invention relates to a housing more particularly intended to receive a cosmetic product such as makeup, the powder box formed with such a housing and its method of use (opening, closing).

A housing is already known comprising:

a recessed bottom provided with:

a transverse wall and a first wall having a generally cylindrical shape with respect to a main axis of the housing and defining, with the transverse wall, a receptacle for makeup;

a recessed cover provided with:

a transverse wall and a first wall having a generally cylindrical shape;

hinge means about a second axis perpendicular to the main axis, connected to the bottom and to the cover at their periphery;

said cover being able to occupy two extreme positions, i.e.:

a locked closed position in which the bottom and the cover are rigidly connected to one another facing one another, and a fully open position in which the cover allows for a clear access to the receptacle of the bottom;

complementary means for locking the bottom and the cover, respectively, provided on their respective first cylindrical walls, which, when they are mutually engaged, make it possible for the cover to be in the locked closed position and which, when they are mutually released, make it possible for the cover to attain and occupy the fully open position.

For example, reference can be made to document U.S. Pat. No. 5,542,561 in which the complementary locking means are threads, the cover being pivoted on a collar having transverse arms, hinged to the bottom.

Document U.S. Pat. No. 2,466,295 relates to connection means for a pivoted opening.

Finally, document U.S. Pat. No. 1,694,185 relates to a powder box including a curved hinge which is deformable for opening and closing purposes, combined with a lock located opposite to the hinge.

The invention refers to housings of the first general type considered.

Its objective is to achieve such a housing in which the problems related to the concomitant existence of a hinge and of a relative pivoting of the cover with respect to the bottom perpendicularly to the hinge ensuring the closing and locking of the housing are eliminated.

The invention can more particularly be used in the case of a sealed powder box.

For this purpose, and according to a first aspect, the invention relates to a housing of the first general type considered which comprises means of assembly connected near the hinge means, the means of assembly comprising a male part and a female part extending in the general direction of the second axis, one of the parts being connected to the bottom and the other to the cover, the female part comprising at least one axial end opening, said opening allowing for the engagement and disengagement of the male part in and from the female part, respectively, the female part having a general shape extending along an arc of a circle centred on the main axis, the male and female parts being able to occupy two extreme positions with respect to one another, i.e.:

an engaged position in which they are connected, the relative pivoting of the cover with respect to the bottom about the second axis being possible, a disengaged position in which they are separated, the pivoting of the cover about the second axis not being possible;

the passage from one of the positions to the other being achieved through a relative pivoting of the cover with respect to the bottom about the main axis.

According to further characteristics, the means of assembly are located at the outer periphery of the housing, on the second cylindrical walls of the bottom and of the cover, particularly on or near their free edges.

According to one embodiment, the female part is provided in the general form of a groove, axially slotted so as to allow the passage of the link adjoining the male part on the one hand, and equipped with its end opening(s) on the other hand. According to optional embodiments, the male part is provided in the general form of a trunnion or a pivot point pair, or equivalent.

The complementary members for locking the bottom and the cover, respectively, comprise at least one peripheral bulge of the bottom and at least one peripheral bulge of the cover on their first cylindrical walls. In the embodiment more particularly considered, said bulges are protrusions. The bulges are directed outwards in the case of the bottom and inwards in the case of the cover, the first cylindrical wall of the cover being placed around and on the outside of that of the bottom. These bulges are located on or near at least some of the free edges of the first cylindrical walls of the bottom and of the cover, respectively, at least substantially on the same transverse plane. They are located at several places about the main axis of the housing, separated by spaces free from bulges whose purpose is to allow for the nesting and release of the cover into and from the bottom, respectively. According to one embodiment, the bulges extend along an arc whose length is in the order of the size or of a fraction of the size of the intermediate space. Thus, the housing may comprise from three to five bulges for the bottom and the cover, respectively, and preferably four.

The hinge means are located substantially facing a space free from bulges of the bottom in the open position of the cover and substantially facing a bulge of the cover on a permanent basis.

The pivoting travel of the cover between its locked closed position and its nonlocked closed position is short, a fraction of a turn, and particularly in the order of 20 to 60°, especially in the order of 30 to 40°.

One or both of the peripheral bulges has or have a helicoid active surface slightly inclined with respect to the transverse plane of the housing, particularly in the order of 4 to 10° and more specifically in the order of 4 to 6°. With this embodiment, a bulge has a thin engagement end for closing purposes and a thick end for stopping the pivoting at the end of travel in the opening direction.

In the embodiment considered, the bottom and the cover each further comprise a second outer wall having a generally cylindrical shape, placed around and on the outside of the first cylindrical wall, respectively, limiting the transverse walls, and therefore the housing, and coming substantially against one another and in line with one another when the housing is in closed position. The free edge of the first cylindrical wall of the bottom is located substantially on the transverse junction plane of the bottom and the cover.

The second axis considered above is located on or near the second cylindrical walls.

In the embodiment considered, the cover comprises an inner peripheral shouldering between the transverse wall and the first cylindrical wall, intended to receive a ring-shaped sealing joint which may be compressed by the first cylindrical wall of the bottom, the receptacle of the bottom of the housing being substantially sealed, in the locked closed position. The first cylindrical wall of the bottom then has a protruding free edge cooperating with the sealing joint in the locked closed position of the cover.

According to the embodiment considered, a mirror is secured inside and against the transverse wall of the cover. A free space is provided between the transverse wall of the cover, the mirror and the upper edge of the first cylindrical wall of the bottom, the makeup accommodated in it, respectively. This space makes it possible to accommodate a removable object such as a powder puff.

According to a first optional embodiment, the means of assembly are essentially distinct from the hinge means, one of the male or female parts being carried by a lug which is pivoted on the bottom or on the cover and is part of or makes up the hinge means. In this optional embodiment, the male part has a general shape extending along an arc of a circle centred on the main axis. The two male and female parts in engaged position are stopped as regards their relative pivoting with respect to one another. The female part is an integral part of the cover or of the bottom. The second axis is located near the transverse wall of the bottom or of the cover to which it is hinged.

According to a second optional embodiment, the means of assembly are essentially common to and combined with the hinge means, the male and female parts forming an integral part of the bottom and of the cover. In this optional embodiment, the male part is provided in the general form of a pivot point pair. The two male and female parts in engaged position can pivot relatively with respect to one another about the second axis. The second axis is located near the joint plane between the bottom and the cover. The relative pivoting of the male and female parts is made possible by the shape which is attributed to them, the clearance existing between them or the elastic deformation possibly attributed to them.

According to a second aspect, the invention relates to an assembly comprising a housing such as described above, and a cosmetic product such as makeup with a solid or pasty consistency placed in the receptacle of the bottom. This assembly forms a powder box. It may further include an object such as a powder puff placed on the cosmetic product.

According to a third aspect, the invention relates to a method for fully opening such a housing or powder box, from the locked closed position. This method comprises the following successive steps:

- a first stage of relative pivoting of the cover with respect to the bottom about the main axis, with a travel making it possible to mutually release the locking members,
- a second stage of relative pivoting of the cover with respect to the bottom about the second axis until the fully open position is attained.

During the first stage, the male and female parts are displaced from their disengaged position to their engaged position.

The method of closing from the fully open position comprises the steps opposite to those described above.

The invention will be more clearly understood upon reading the detailed description which follows, made with reference to the attached drawings provided as non limiting examples.

Figure 1:
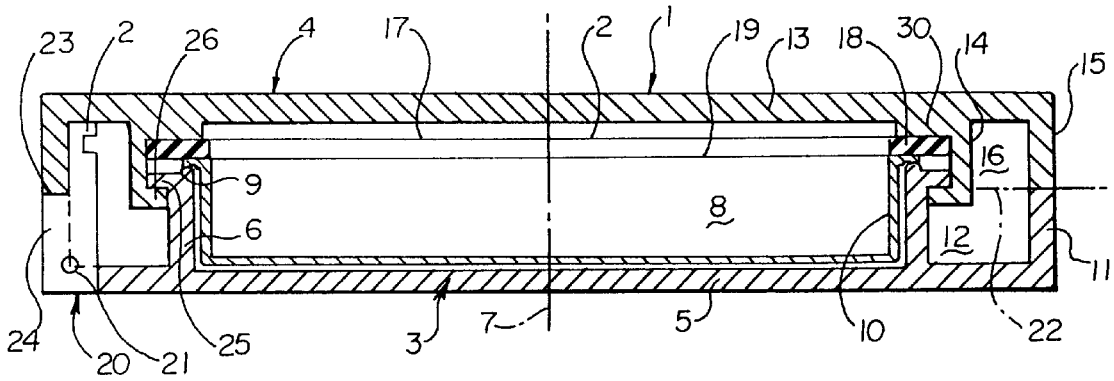
FIG. 1 is a schematic view of a cross section along an axial plane of a housing according to the invention, according to a first optional embodiment, in locked closed position.
Figure 2:
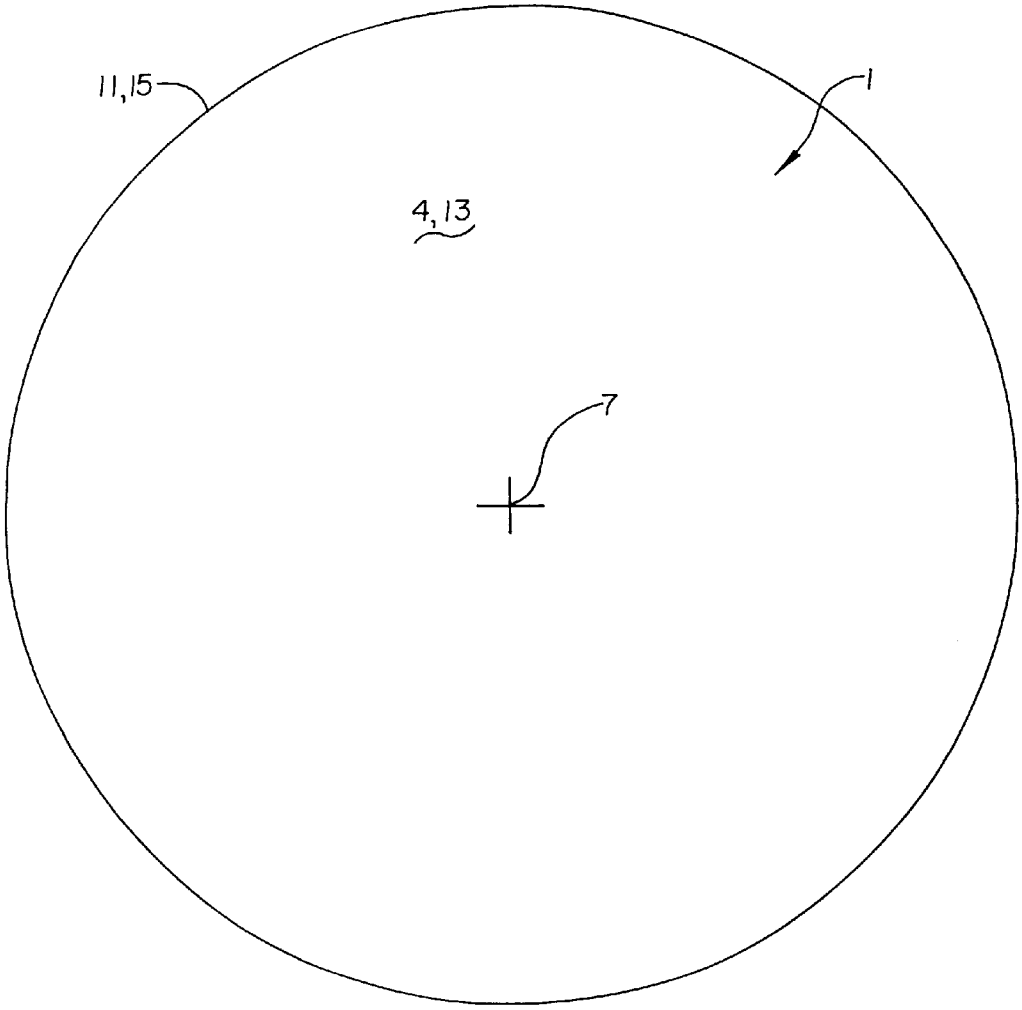
FIG. 2 is a top view of the housing of FIG. 1.
Figure 7:
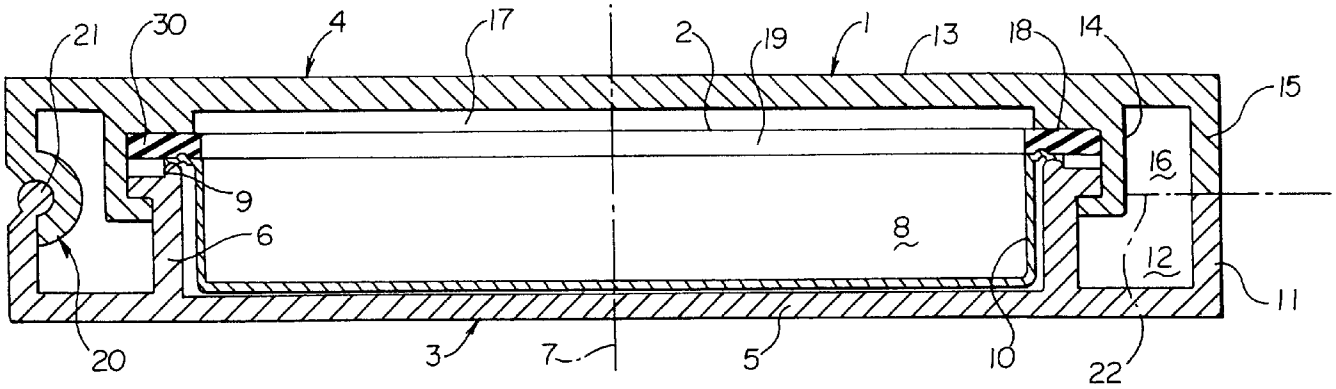

FIG. 7 corresponds to FIG. 1 for a second optional embodiment.

Figure 3:
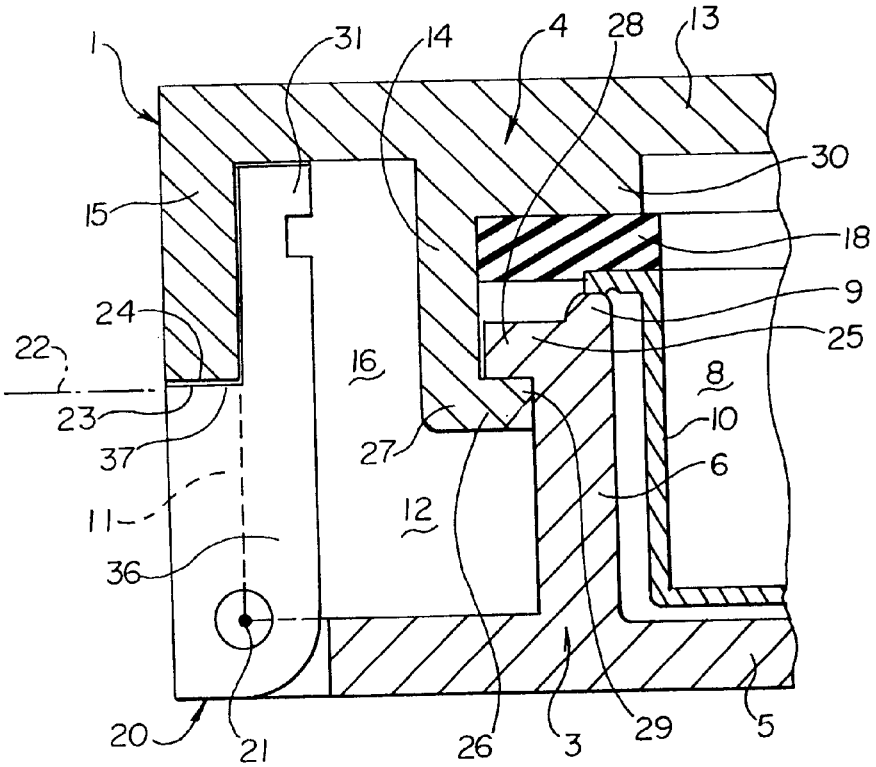
FIGS. 3, 4 and 5 are three partial schematic views corresponding to the view of FIG. 1, illustrating the means of assembly and the hinge means in three particular positions of the housing, locked closed, nonlocked closed and fully open, respectively.
Figure 4:
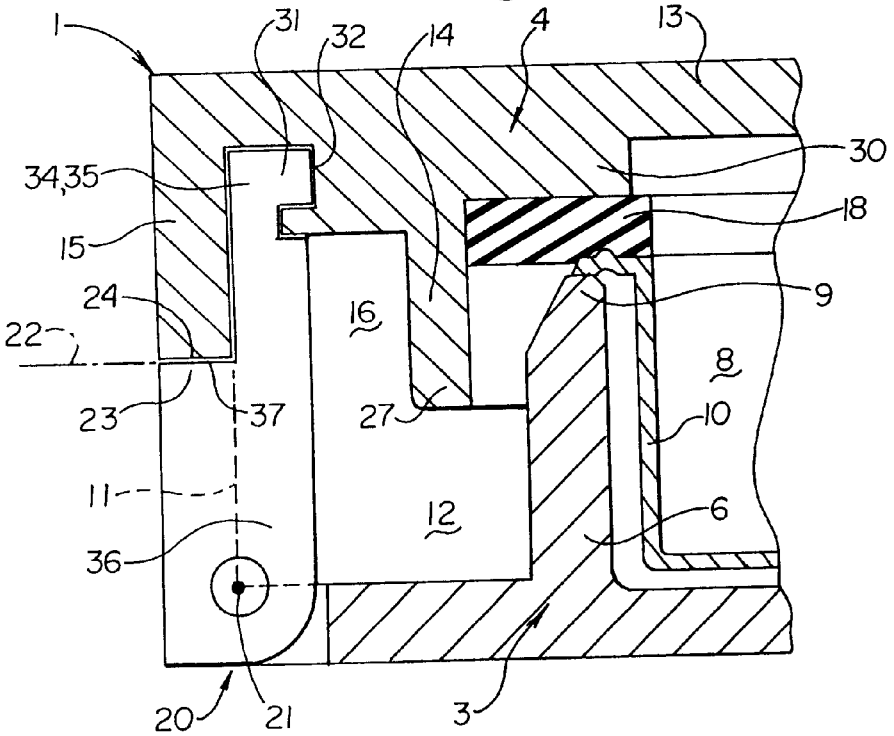
Figure 5:
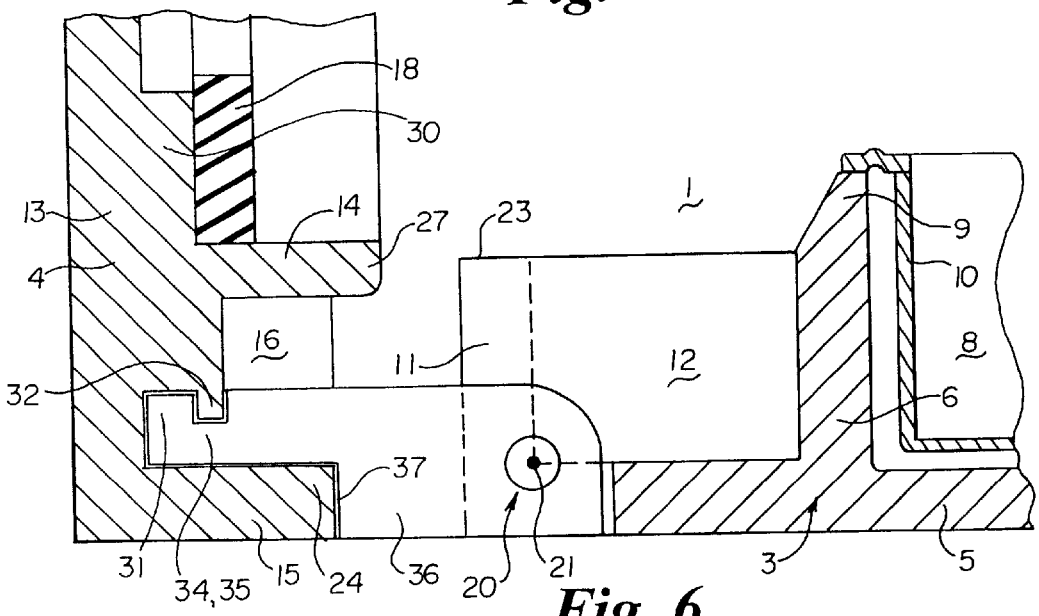
Figure 6:
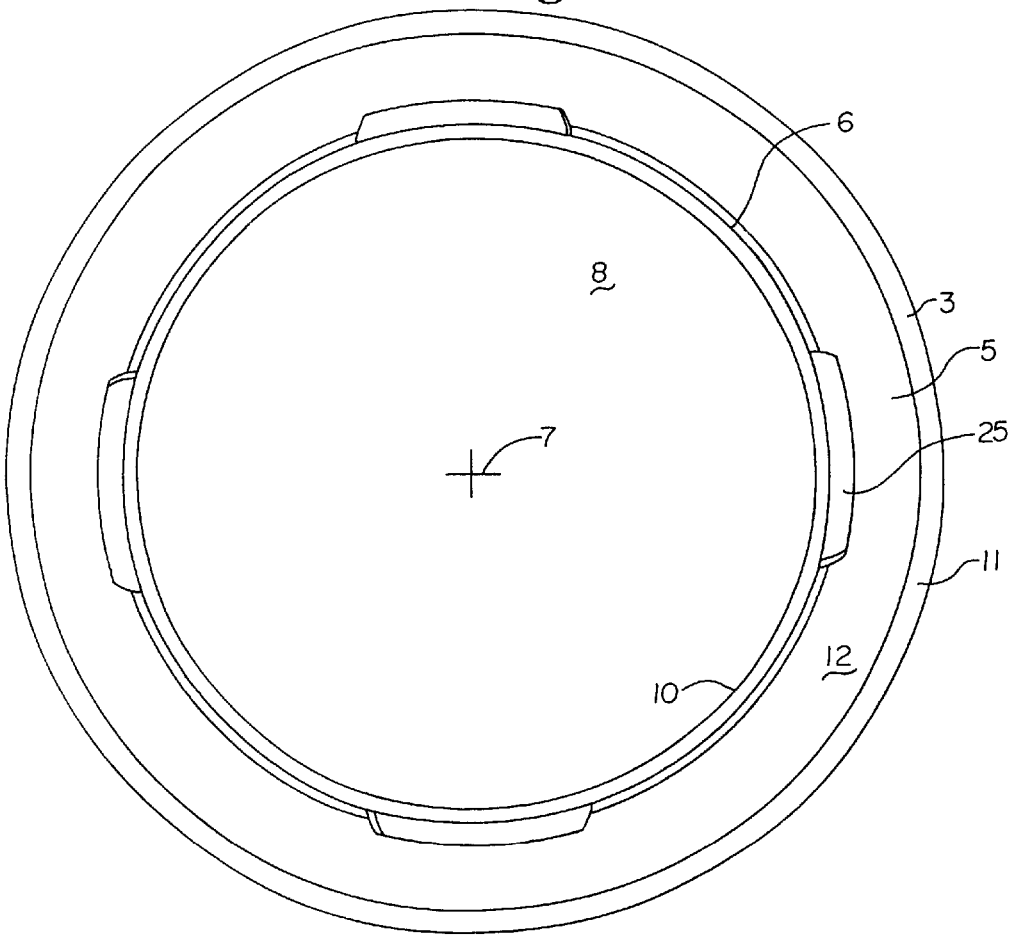
FIG. 6 is a top view of the interior of the bottom of the housing, in fully open position.
Figure 8:
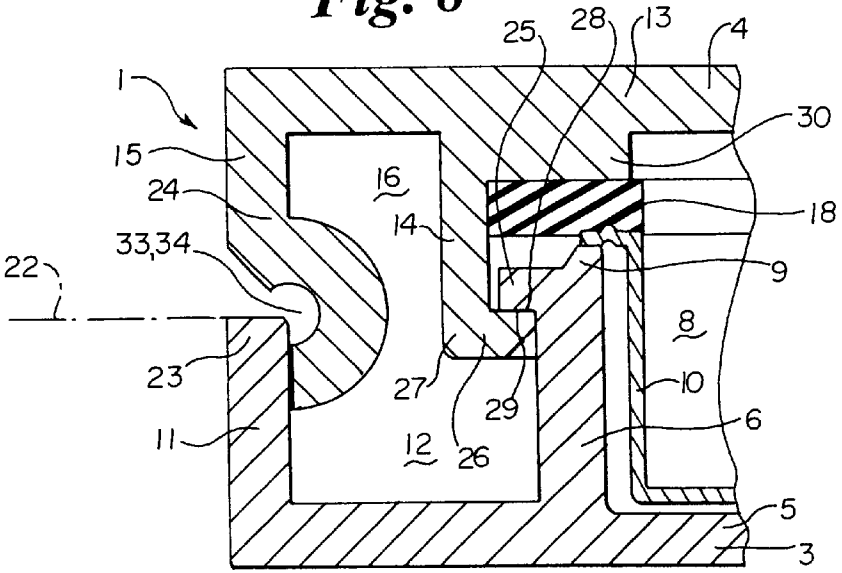
Figure 9:
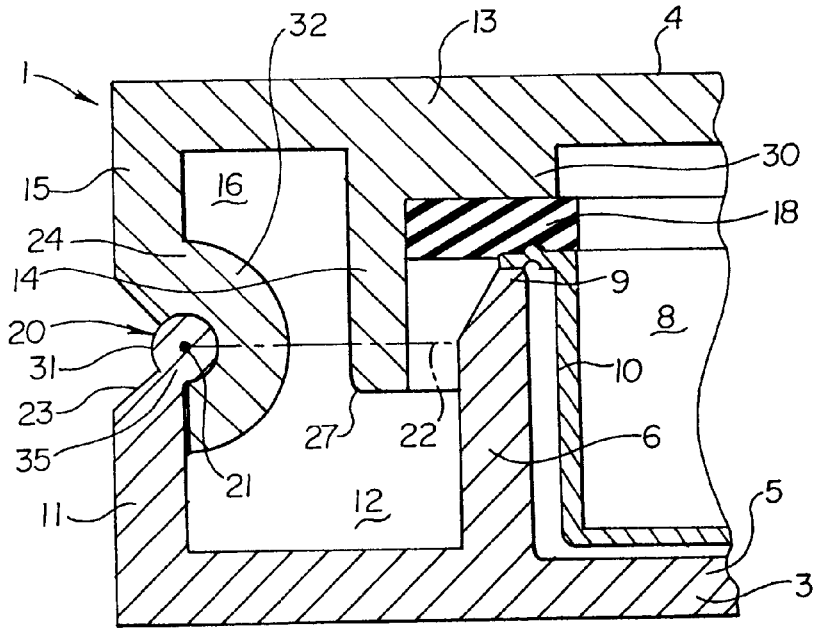
Figure 10:
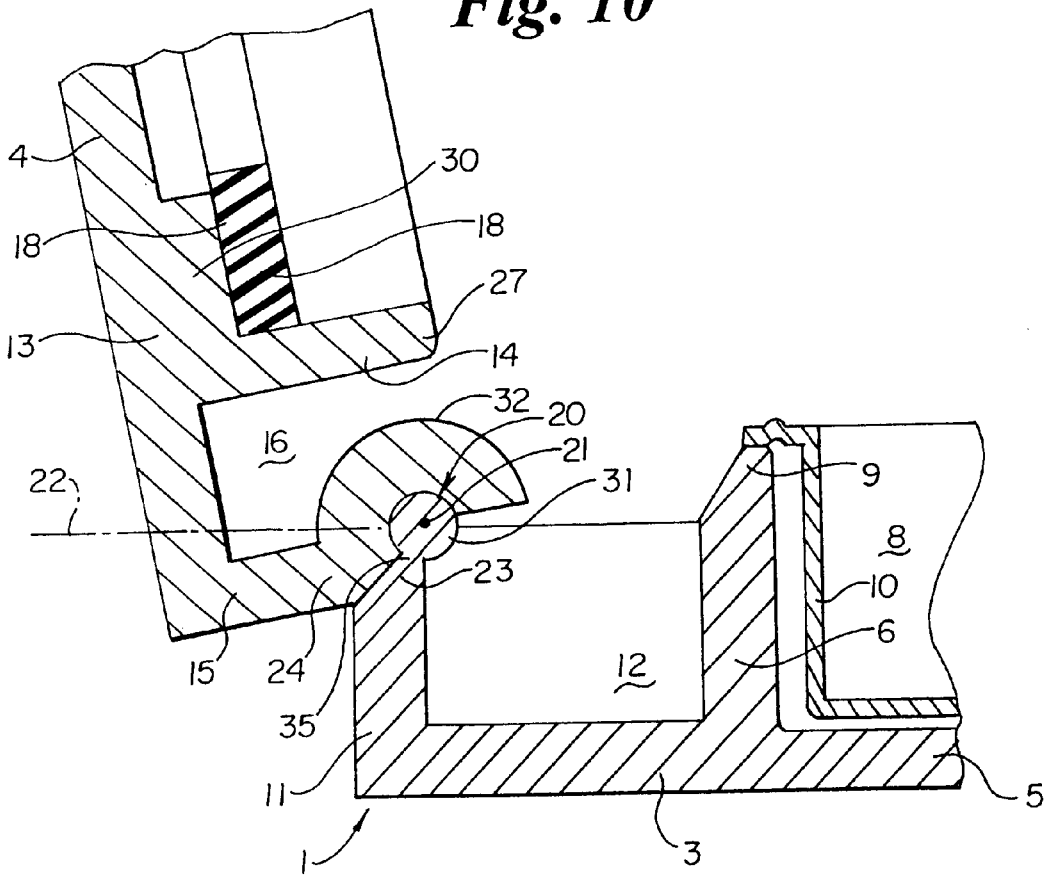

FIGS. 8, 9 and 10 correspond to FIGS. 3, 4 and 5, respectively, for the second optional embodiment.

Figure 11:
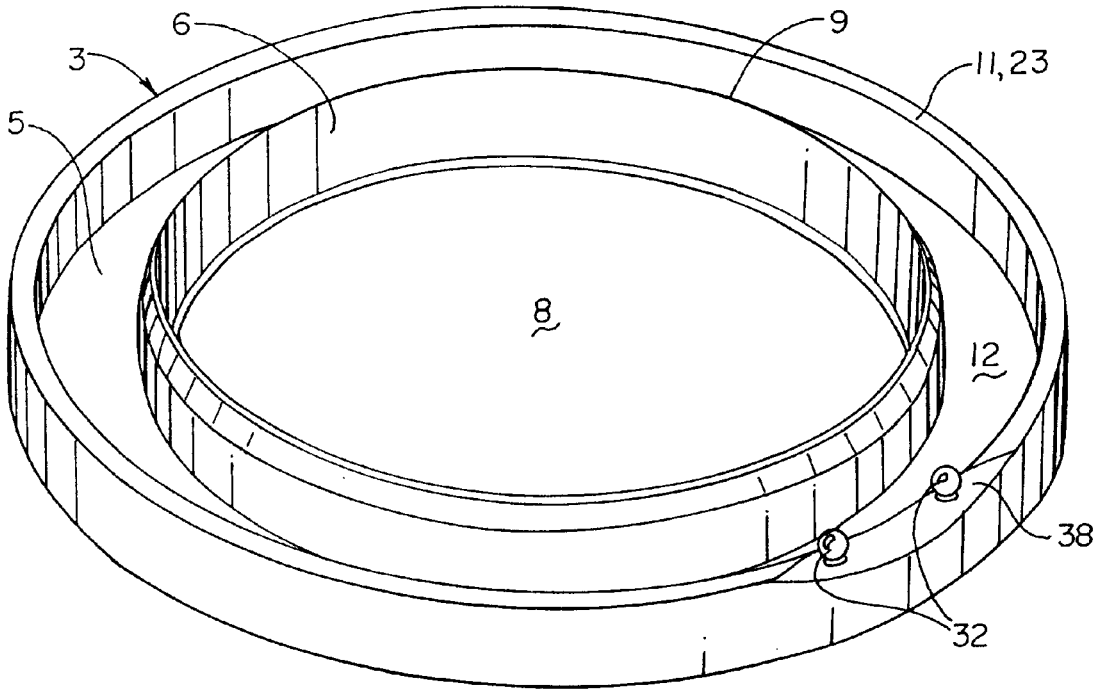

FIG. 11 is a perspective view of only the bottom of the housing according to the second optional embodiment.

Figure 12:
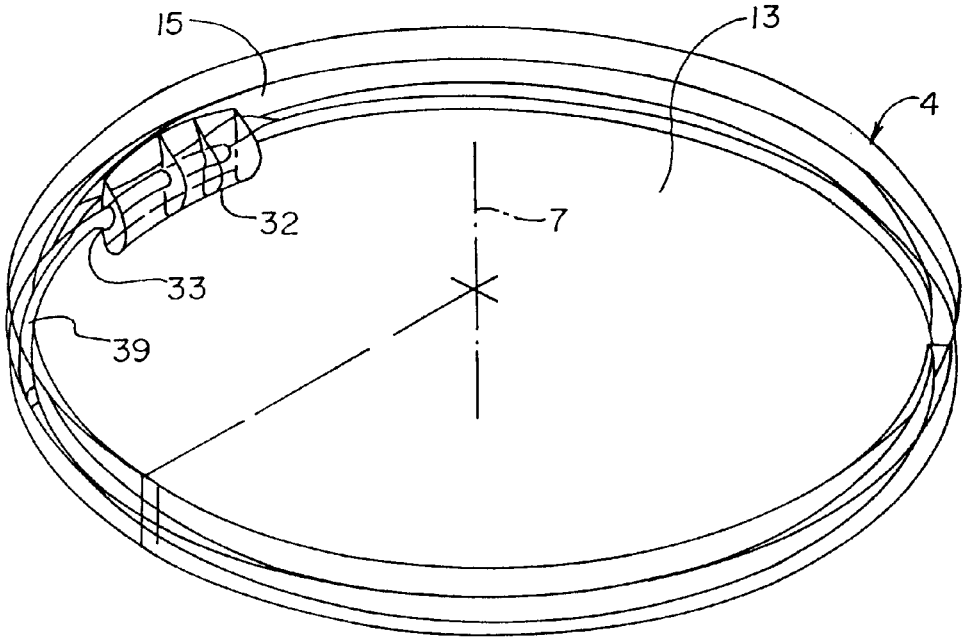

FIG. 12 is a sketch partially illustrating the cover of the second optional embodiment.

A housing 1 according to the invention, made of plastic material, is more specifically intended to receive a cosmetic product such as makeup with a solid or pasty consistency.

The makeup in question may need to be protected against humidity or ambient air.

For this purpose, the housing 1 is designed so as to be substantially sealed when this is required.

If necessary, the powder box formed by the housing 1 and the makeup may also comprise an object such as a powder puff, placed on the makeup.

Moreover, the housing 1 may comprise a mirror 2 inside it.

In the embodiment shown, the housing 1 comprises a bottom 3 and a cover 4, both essentially rigid.

The bottom 3 and the cover 4 are both recessed.

The bottom 3 comprises a transverse wall 5 forming the bottom itself and, protruding from said transverse wall, a first wall 6 having a generally cylindrical shape with a circular base.

Wall 6 makes it possible to define an axis 7 which is the main axis of the housing, which wall 5 is perpendicular to.

The inner surface of walls 5 and 6 defines a receptacle 8 for the makeup.

The latter can fill the receptacle 8 until it is flush with the free edge 9 of wall 6, opposite to wall 5.

If necessary, the makeup may fill a cup 10, which is mounted on the receptacle 8.

Depending on the embodiment, the bottom 3 may or may not consist of a single piece.

In particular, the part forming the receptacle 8 and/or the cup 10 may be distinct from the peripheral part and rigidly mounted on the latter, like a spare part.

The bottom 3 includes a second peripheral wall 11, about an axis 7, limiting the wall 5, and therefore the housing, in a peripheral manner.

The outer wall 11 is placed around the inner wall 6, on the outside of it.

The two walls 6, 11 are separated by a ring-shaped space 12.

The overall axial height of wall 6 is slightly greater than that of wall 11. The first therefore protrudes a bit from the second, slightly set back.

The cover 4 itself has a general structure similar to that of the bottom 3. It comprises:

- a transverse wall 13 forming the top of the housing 1;
- a first inner cylindrical wall 14;
- a second cylindrical wall 15 surrounding the wall 14 on the outside, thus forming a space 16 with it.

The mirror 2, when provided, is secured (for example, by bonding at 17) to the interior of the cover 4, against the inner surface of wall 13.

The mirror 2 may extend substantially until wall 14, provided that a ring-shaped sealing joint 18 is installed.

The shape attributed to the bottom 3 and to the cover 4 makes it possible to arrange a free space 19 between the wall 13, or the mirror 2 when provided, and the edge 9, the free surface of the makeup, respectively.

This space 19 makes it possible to accommodate the removable powder puff, or equivalent.

The overall axial height of wall 14 is slightly greater than that of wall 15. The first therefore protrudes a bit from the second, slightly set back.

In the embodiments shown, walls 5 and 13 are flat. Nevertheless, they could be curved, for example with their concave sides facing the interior of the housing 1.

This arrangement is valid for one or both of parts 3, 4.

In the case of such a curved shape, walls 11 and 15 may merely consist of a prolongation, or even the end part of walls 5 and 13.

Moreover, the housing 1, or its constituent parts, may include recessed, bulged, conformed decorative elements.

The housing 1 also comprises hinge means 20, referred to as hinge hereinafter, about a second axis 21.

Axis 21 is perpendicular to axis 7.

The hinge 20 is connected to the bottom 3 and to the cover 4. It is located on the outer periphery of the housing 1.

The cover 4 may occupy, with respect to the bottom 3 and due to the hinge 20, two extreme positions, i.e.:

- a locked closed position in which the bottom 3 and the cover 4 are rigidly connected to one another, top to bottom, with their inner recesses in communication and facing one another (FIGS. 1, 3, 7, 8).

In this position, walls 5 and 13 are substantially parallel and facing one another. Walls 11 and 15 come substantially against one another at their free edges and in line with one another. They define a transverse junction plane 22 at their respective free edges 23 and 24.

In this position, axis 7 is common to the bottom 3 and to the cover 4;

- a fully open position in which the cover 4 allows for a clear access to the receptacle 8 of the bottom, and therefore to the makeup, and in which the mirror 2 may be used (FIGS. 5, 10).

In this position, walls 5 and 13 therefore lie on two planes inclined in the order of 900 or slightly more with respect to one another.

Moreover, the housing 1 may occupy a typical intermediate position, referred to as nonlocked closed (FIGS. 4, 9).

This position differs from the locked closed position in that, from this position, it is possible, through a simple relative pivoting movement of the cover 4 about the second axis 21, to attain the fully open position. On the contrary, this operation is not possible from the locked closed position since, as a matter of fact, in this position the bottom 3 and the cover 4 are locked by means of respective members 25, 26.

The housing 1 therefore also comprises the locking members 25, 26, complementary to one another, connected to the bottom 3 and to the cover 4, respectively.

These members 25, 26 are provided on walls 6, 14, respectively, as described hereinafter.

When the members 25, 26 are mutually engaged, the cover 4 is in the locked closed position.

When the members 25, 26 are mutually released, the cover 4 may attain and occupy the fully open position. In particular, the cover 4 may occupy the nonlocked closed position.

In the embodiment considered, the members 25, 26 are respectively provided in the form of a peripheral bulge, such as a protrusion.

The members 25, 26 shall now be described with reference to the cases where the cover 4 is in closed position (locked or nonlocked), the bottom 3 and the cover 4 being coaxial with axis 7.

Member 25 is directed transversely (with respect to axis 7) towards the exterior of the housing 1 and member 26 is directed towards the interior.

In this embodiment, wall 14 is placed around, on the outside of and near wall 6.

More specifically, member 25 is located near the free edge 9, which protrudes axially from member 25 so as to be able to cooperate with the joint 18 in the locked closed position.

Member 26 is located on the free edge 27 of wall 14.

The members 25, 26 are located at least substantially on the same transverse plane, along or near the junction plane 22. In other words, the members 25, 26 do not extend along axis 7 like screw threads.

The free edges 9, 23, 24 and 27 are substantially merged with or close to said plane 22, at the relative near positions indicated.

In the embodiment shown, four members 25 and four members 26 are provided for, arranged at regular intervals about axis 7.

The respective members 25 and 26 have a similar general shape, subject to adaptations made necessary by the structural context.

The members 25, 26 are located at four respective positions and are separated by spaces free from protrusions.

This structural arrangement makes it possible to nest and release the cover 4 into and from the bottom 3, respectively, starting from the nonlocked closed position, when members 25 are placed facing the spaces between members 26 and, conversely, when members 26 are facing the spaces between members 25.

The members 25, 26 extend respectively along an arc of small length, in the order of the size or of a fraction of the size of the intermediate space. In any case, the peripheral extensions of the members 25, 26 are such that the above-mentioned nesting and release are possible.

The active surface—for the locking—of members 25 is the one facing wall 5. And the one 29 for members 26 is facing wall 13.

In the normal situation of use where the housing 1—or powder box—is placed with wall 5 substantially horizontal, the bottom 3 in lower position and the cover 4 in upper position, plumb with one another, members 25 are located at a mean level very slightly above that of members 26.

In the embodiment shown, the hinge 20 is located facing a space between two members 25, when the cover 4 is in fully open position. The hinge 20 is located substantially facing a member 26 on a permanent basis.

The pivoting travel of the cover 4 about axis 7 between its locked closed position and its nonlocked closed position is very short, a fraction of a turn, and particularly in the order of 20 to 60°, especially in the order of 30 to 40°.

One or both of the active surfaces 28, 29 is helicoidal and slightly inclined with respect to plane 22. This inclination, just sufficient for locking purposes and, especially, for the compression of the joint 18, is in the order of 4 to 10° and more specifically in the order of 4 to 6°.

A member 25, 26 has a thin engagement end for closing purposes and a thick end for stopping the pivoting at the end of pivoting travel (about axis 7).

As a result, the axial displacement travel of wall 14 with respect to wall 6 during the pivoting—about axis 7—with a view to opening or, on the contrary, closing the housing—is small, just for the appropriate compression of the joint 18.

The cover 4 also comprises an inner peripheral shouldering 30 located against wall 13 and adjoining wall 14, on the inside, so as to be placed facing wall 6.

The ring-shaped joint 18 is applied, particularly by bonding, on the shouldering 30.

In the embodiment considered, the cross section of this joint has a rectangular contour.

This is properly adapted to the structure of the housing. It must be noted that the free edge of wall 6 cooperating with the joint, or the cup 10, extends sufficiently in the radial direction—thickness of wall 6—to ensure, in combination with the extent of the joint, the required sealing.

The joint 18 may be made of a compressible plastic material, such as foam.

In the first optional embodiment, the second axis 21 is located at the junction of walls 5 and 11. In the second optional embodiment, it is located substantially on plane 22, i.e. on or near walls 11 and 15.

The housing 1 also includes means of assembly comprising a male part 31 and a female part 32.

These means of assembly 31, 32 are connected to the hinge 20 and placed near it (or even merged with it in the second optional embodiment). They are located on the outer periphery of the housing 1.

One of the parts 31, 32 is connected to the bottom 3, and the other is connected to the cover 4.

In the embodiment considered, the male part 31 is connected to the bottom 3 and the female part 32 is connected to the cover 4.

The description which follows is made with reference to this particular embodiment.

The female part 32 extends in the general direction of the second axis 21. It comprises at least one axial end opening 33 allowing for the engagement and disengagement of the male part 31 into and from the female part 32, respectively, said engagement and disengagement taking place axially.

The term "axially" is used herein to refer to the direction in which the female part 32 extends.

The female part 32 has a general shape extending along an arc of a circle centred on axis 7. Its shape matches the curved shape of the housing 1.

The arc of a circle of the female part 32 is located at a specific position. Its extent or dimension is very small compared to the length of the periphery of the housing.

For example, the arc of a circle of the female part 32 has a dimension in the order of that of the hinge 20, which is also very small.

The male 31 and female parts 32 may occupy two extreme positions with respect to one another, i.e.:

- an engaged position in which they are connected to one another, the relative pivoting of the cover 4 with respect to the bottom 3 about the second axis 21 being possible,
- a disengaged position in which they are separated, the pivoting of the cover 4 about the second axis 21 not being possible.

The passage from one of the positions to the other is achieved through a relative pivoting of the cover 4 with respect to the bottom 3 about the main axis 7, in one direction or the other.

The male part 31 is generally located on wall 11 towards its edge 23. The female part 32 is generally located on wall 15 towards wall 13 (first optional embodiment) or towards edge 24 (second optional embodiment).

Generally speaking, the female part 32 is provided in the form of a groove, equipped with an axial slot 34 so as to allow the passage of the link 35 adjoining the male part 31 on the one hand, and equipped with its end opening(s) 33 on the other hand.

As for the male part 31, it is provided in the general form of a trunnion or a pivot point pair, or equivalent.

Reference shall now be made to FIGS. 1 to 6 in particular, which correspond to a first optional embodiment of the means of assembly 31, 32.

In this optional embodiment, the means of assembly 31, 32 are essentially distinct, although close to and associated with the hinge 20.

The hinge 20 defines the axis 21 located at the junction of walls 5 and 11. At one end, the hinge is formed by the bottom 3. At the other end, it is formed by a lug 36. The bottom 3 and the lug 36 are connected so to pivot about axis 21 by a trunnion, snugs or in any other appropriate manner.

The lug 36 is conformed like a sector of wall 11. The latter is provided with a corresponding complementary scalloping.

In the closed position of the cover, the lug 36 may be accommodated in the scalloping, as a continuation of wall 11.

In the fully open position of the cover 4, the lug 36 prolongs wall 5, in the embodiment considered, towards the exterior of the housing 1.

The lug 36 has an axial length along axis 7 greater than that of wall 11. It protrudes from the free edge 23 of the latter.

This arrangement makes it possible for the lug 36 to enter the cover 4, in space 12, until near wall 13.

Opposite to wall 5 and axis 21, the lug 36 has the male part 31 attached to the rest of the lug by the thin link 35.

In this embodiment, the male part 31 forms a mortise extending, like the female part 32, along an arc of a circle centred on axis 7. The male 31 and female parts 32 have complementary shapes such that, combined with the shape of the link 35 and of the cover 4, they cannot pivot with respect to one another in a parallel manner about axis 21.

For example, the male part 31 has a square or polygonal section (transversely with respect to the direction in which the female part 32 extends), identical to that of the groove of the female part 32.

In the embodiment considered, the female part 32 is an integral part of the cover 4. It is formed by the abovementioned groove located against the inner surface of wall 13, adjoining wall 15.

In this embodiment, the lug 36 comprises an outer step 37 defining, towards the male part 31, a smaller thickness for accommodating the wall 15.

Reference shall now be made to FIGS. 7 to 10 in particular, which correspond to a second optional embodiment of the means of assembly 31, 32.

In this optional embodiment, the means of assembly 31, 32 are essentially common to and combined with the hinge 20.

The hinge 20 defines the axis 21 located at the junction of walls 11 and 15, i.e. near plane 22.

At one end, the hinge is formed by the bottom 3 provided with the male part 31.

At the other end, it is formed by the cover 4 provided with the female part 32.

The male part 31 forms the trunnion of the hinge and defines axis 21.

The male part 31 is provided in the general form of a pivot point pair arranged on the free edge 23.

These two pivot points are slightly spaced at an angle from one another.

The female part 32 is a groove achieved by a rounded form prolonging the wall 15 towards its free edge 24.

The slot 34 of the groove 32 is directed towards the exterior of the housing 1. This slot is sufficiently wider or more open than the link 35 so that the latter will not be blocked in the slot and, on the contrary, so that it may be displaced when a pivoting movement about axis 21 is performed.

In addition, the pivot point shape attributed to the male part 31 and the rounded section attributed to the groove of the female part 32 are such that, in engaged position, the two male and female parts 31, 32 may pivot with respect to one another about axis 21.

In other embodiments of this second option, the relative pivoting of the male and female parts 31, 32 is made possible by the shape which is attributed to them, the clearance existing between them or the elastic deformation possibly attributed to them.

If necessary, it is possible for the male part 31 to be achieved at the location of a scalloping 38 provided in wall 11 towards its edge 23.

In addition, at the opening 33 through which the female part 32 is introduced, a recess 39 of the wall 15 of the cover 4 may be provided to enable the release of the male part 31 from the female part 32.

It is understood that the bottom 3 and the cover 4 may be inverted.

The same applies to the means of assembly.

The method for fully opening a housing 1 or powder box such as described above, from the locked closed position, comprises the following successive steps:

a first stage of relative pivoting of the cover 4 with respect to the bottom 3 about the main axis 7, with a travel making it possible to mutually release the locking members 25, 26; and a second stage of relative pivoting of the cover 4 with respect to the bottom 3 about the second axis 21 until the fully open position is attained.

During the first stage, the male 31 and female parts 32 are displaced relatively from their disengaged position to their engaged position.

The method is clearly illustrated by the sequence of FIGS. 3, 4 and 5 for the first embodiment; 8, 9 and 10 for the second.

In FIGS. 3 and 8, the male and female parts 31, 32 are released, the housing or powder box being in locked closed position.

Through a relative pivoting of the cover 4 about axis 7, the male and female parts 31, 32 attain their engaged position, as shown in FIGS. 4 and 9. In this position, the locking members 25, 26 are mutually released, the housing 1 or powder box being in nonlocked closed position.

Through a relative pivoting of the cover 4 about axis 21, with the male and female parts 31, 32 remaining engaged, the cover 4 attains the fully open position, shown in FIGS. 5 and 10.

What is claimed is:

1. A housing particularly for a cosmetic product such as makeup, comprising:

a recessed bottom (3) provided with:

a transverse wall (5) and a first wall (6) having a generally cylindrical shape with respect to a main axis (7) of the housing and defining, with the transverse wall (5), a receptacle (8) for makeup;

a recessed cover (4) provided with:

a transverse wall (13) and a first wall (14) having a generally cylindrical shape;

hinge means (20) about a second axis (21) perpendicular to the main axis (7), connected to the bottom (3) and to the cover (4) at their periphery;

said cover (4) being able to occupy two extreme positions, a locked closed position in which the bottom (3) and the cover (4) are rigidly connected to one another facing one another, and a fully open position in which the cover (4) allows for a clear access to the receptacle of the bottom (3);

complementary means (25, 26) for locking the bottom (3) and the cover (4), respectively, provided on their respective first cylindrical walls (6, 14), which, when they are mutually engaged, make it possible for the cover (4) to be in the locked closed position and which, when they are mutually released, make it possible for the cover (4) to attain and occupy the fully open position;

the housing comprising means of assembly (31, 32) connected near the hinge means (20), the means of assembly (31, 32) comprising a male part (31) and a female part (32) extending in the general direction of the second axis (21), one of the parts (31, 32) being connected to the bottom (3) and the other detachably to the cover (4), the female part (32) comprising at least one axial end opening (33), said opening (33) allowing for the engagement and disengagement of the male part (31) in and from the female part (32), respectively, the female part (32) having a general shape extending along an arc of a circle centred on the main axis, the male and female parts (31, 32) being able to occupy two extreme positions with respect to one another, i.e.:

an engaged position in which they are connected, the relative pivoting of the cover (4) with respect to the bottom (3) about the second axis (21) being possible, a disengaged position in which they are separated, the pivoting of the cover (4) about the second axis (21) not being possible;

the passage from the positions to the other being achieved through a relative pivoting of the cover (4) with respect to the bottom (3) about the main axis (7).

2. A housing according to claim 1, in which the means of assembly (31, 32) are located at a position on the periphery of the housing and have a small dimension in comparison with the length of this periphery.

3. A housing according to claim 1, in which the female part (32) is provided in the general form of a groove, axially slotted (34) so as to allow the passage of the link (35) adjoining the male part (31) on the one hand, and equipped with its end opening(s) (33) on the other hand.

4. A housing according to claim 1, in which the male part (31) is provided in the general form of a trunnion or a pivot point pair.

5. A housing according to claim 1, in which the bottom (3) and the cover (4) each comprise a second outer wall (11, 15) having a generally cylindrical shape, placed around and on the outside of the first cylindrical wall (6, 14), respectively, limiting the transverse walls (5, 13), and therefore the housing, and coming substantially against one another and in line with one another when the housing is in closed position.

6. A housing according to claim 1, in which the free edge (9) of the first cylindrical wall (6) of the bottom (3) is located substantially on the transverse junction plane (22) of the bottom (3) and the cover (4).

7. A housing according to claim 1, in which the second axis (21) is located on or near the second cylindrical walls (11, 15).

8. A housing according to claim 1, in which the cover (4) comprises an inner peripheral shouldering (30) between the transverse wall (13) and the first cylindrical wall (14), intended to receive a ring-shaped sealing joint (18) which may be compressed by the first cylindrical wall (6) of the bottom (3), the receptacle (8) of the bottom (3) of the housing being substantially sealed in the locked closed position, the first cylindrical wall (6) of the bottom (3) has a protruding free edge cooperating with the sealing joint (18) in the locked closed position of the cover (4).

9. A housing according to claim 1, in which a mirror (2) is secured inside and against the transverse wall (13) of the cover (4).

10. A housing according to claim 1, in which a free space (19) is provided between the transverse wall (13) of the cover (4), the mirror (2) and the free edge (9) of the first cylindrical wall (6) of the bottom (3), respectively; this space (19) making it possible to accommodate a removable object such as a powder puff.

11. A housing according to claim 1, in which the means of assembly (31, 32) are located at the outer periphery of the housing on the first cylindrical walls (6, 14) of the bottom (3) and of the cover (4).

12. A housing according to claim 11, in which the means of assembly (31, 32) are located on or near at least some of the free edges (23, 24) of the second cylindrical walls (11, 15) of the bottom (3) and of the cover (4).

13. A housing according to claim 1, in which the means of assembly (31, 32) are essentially distinct from the hinge means (20),the male (31) or female (32) parts being carried by a lug (36) which is pivoted on the bottom (3) or on the cover (4) and makes up the hinge means (20).

14. A housing according to claim 13, in which the male part (31) has a general shape extending along an arc of a circle centred on the main axis (7), the two male and female parts (31, 32) in engaged position are stopped as regards their relative pivoting with respect to one another, the female part (32) is an integral part of the bottom (3) or of the cover (4), the second axis (21) is located near the transverse wall (13, 6) of the bottom (3) or of the cover (4) to which it is hinged.

15. A housing according to claim 1, in which the means of assembly (31, 32) are essentially common to and combined with the hinge means (20), the male (31) and female (32) parts forming an integral part of the bottom (3) and of the cover (4).

16. A housing (1) according to claim 15, in which the male part (31) is provided in the general form of a pivot point pair, the two male and female parts (31, 32) in engaged position can pivot relatively with respect to one another about the second axis (21), the second axis (21) is located near the junction plane (22) between the bottom (3) and the cover (4), the relative pivoting of the male and female parts (31, 32) is made possible by the shape which is attributed to them, the clearance existing between them or the elastic deformation possibly attributed to them.

17. A powder box comprising a housing (1) according to claim 1, and a cosmetic product such as makeup (3) with a solid or pasty consistency placed in the receptacle (8) of the bottom (3), directly or by means of a cup (10).

18. A powder box according to claim 17 further including an object such as a powder puff placed on the cosmetic product.

19. A method for fully opening such a housing (1) according to claim 1, from the locked closed position, comprising the following successive steps:

a first stage of relative pivoting of the cover (4) with respect to the bottom (3) about the main axis (7), with a travel making it possible to mutually release the locking members (25, 26), a second stage of relative pivoting of the cover (4) with respect to the bottom (3) about the second axis (21) until the fully open position is attained.

20. A method according to claim 19, in which that during the first stage, the male and female parts (31, 32) are displaced from their disengaged position to their engaged position.

21. A housing according to claim 1, in which the locking members (25, 26) comprise at least one peripheral bulge of the bottom (3) and at least one peripheral bulge of the cover (4).

22. A housing according to claim 21, in which said bulges (25, 26) are protrusions.

23. A housing according to claim 21, in which the bulges such as protrusions (25, 26) are directed outwards in the case of the bottom (3) and inwards in the case of the cover (4), the first cylindrical wall (14) of the cover (4) being placed around and on the outside of that (6) of the bottom (3).

24. A housing according to claim 21, in which the bulges such as protrusions (25, 26) are located on or near the free edges (9, 27) of the first cylindrical walls (6, 14) of the bottom (3) and of the cover (4), respectively.

25. A housing according to claim 21, in which the bulges such as protrusions (25, 26) are respectively located at least substantially on the same transverse plane.

26. A housing according to claim 21, which one or both of the bulges such as protrusions (25, 26) has or have a helicoid active surface (28) slightly inclined with respect to the transverse plane of the housing, particularly in the order of 4 to 10° and more specifically in the order of 4 to 6°, a bulge such as a protrusion (25, 26) with an inclined active surface (28) has a thin engagement end for closing purposes and a thick end for stopping the pivoting in the opening direction.

27. A housing according to claim 21, in which the bulges such as protrusions (25, 26) are located at several positions about the main axis (7) of the housing, separated by spaces free from bulges whose purpose is to allow for the nesting and release of the cover (4) into and from the bottom (3), respectively.

28. A housing according to claim 27, in which the bulges such as protrusions (25, 26) extend along an arc whose length is in the order of the size or of a fraction of the size of the intermediate space.

29. A housing according to claim 27, in which it comprises from three to five bulges such as protrusions (25, 26) for the bottom (3) and the cover (4), respectively, and preferably four.

30. A housing according to claim 27, in which the bulges such as protrusions (25, 26) are arranged at regular intervals about the main axis (7), the bulges such as protrusions (25, 26) of the bottom (3) and of the cover (4), respectively, are identical in number and have a similar general shape, in the open position of the cover (4), the hinge means (20) are located substantially facing a space free from bulges such as a protrusion (25) of the bottom (3), the hinge means (20) are permanently located substantially facing a bulge such as a protrusion (26) of the cover (4) the pivoting travel of the cover (4) between its locked closed position and its non-locked closed position is very short, a fraction of a turn, and particularly in the order of 20 to 60°, especially in the order of 30 to 40°.

* * * * *